US008834283B2

(12) United States Patent
Byron

(10) Patent No.: US 8,834,283 B2
(45) Date of Patent: Sep. 16, 2014

(54) BOWLING PRACTICE DEVICE AND METHOD

(71) Applicant: Eileens's Bowling Buddy, LLC, Denver, CO (US)

(72) Inventor: Rex William Byron, Denver, CO (US)

(73) Assignee: Eileen's Bowling Buddy, LLC, Denver, CO (US)

( * ) Notice: Subject to any disclaimer, the term of this patent is extended or adjusted under 35 U.S.C. 154(b) by 0 days.

(21) Appl. No.: 13/733,115

(22) Filed: Jan. 2, 2013

(65) Prior Publication Data

US 2013/0281222 A1 Oct. 24, 2013

Related U.S. Application Data

(60) Provisional application No. 61/637,658, filed on Apr. 24, 2012.

(51) Int. Cl.

| | |
|---|---|
| ***A63B 23/12*** | (2006.01) |
| ***A63B 69/00*** | (2006.01) |
| ***A63B 21/072*** | (2006.01) |
| *A63B 21/075* | (2006.01) |

(52) U.S. Cl.

CPC ..... *A63B 69/0046* (2013.01); *A63B 21/075* (2013.01); *A63B 21/072* (2013.01)

USPC ..... 473/69

(58) Field of Classification Search

CPC ..... A63B 69/0046

USPC ..... 473/69, 208

See application file for complete search history.

(56) References Cited

U.S. PATENT DOCUMENTS

| | | | | | |
|---|---|---|---|---|---|
| 1,005,791 | A | * | 10/1911 | Angell | 482/93 |
| 1,361,902 | A | * | 12/1920 | Porteous | 114/219 |
| D98,005 | S | | 12/1935 | Kohaut | |
| 2,321,524 | A | | 6/1943 | Schafer | |
| 3,149,839 | A | | 9/1964 | Materia | |
| 3,224,012 | A | | 12/1965 | Hamm | |
| 3,398,951 | A | | 8/1968 | Disko | |
| 3,563,545 | A | | 2/1971 | Rasche | |
| 3,595,575 | A | | 7/1971 | Gooch | |
| 3,649,013 | A | | 3/1972 | Foster | |
| 3,756,594 | A | | 9/1973 | Goodwin | |
| 3,770,270 | A | | 11/1973 | Ingold | |
| D238,192 | S | | 12/1975 | Jennings | |
| 3,975,015 | A | | 8/1976 | Owens et al. | |
| 4,034,979 | A | | 7/1977 | Wester | |
| D245,429 | S | | 8/1977 | Arluck | |
| 4,088,318 | A | | 5/1978 | Massman | |
| 4,132,407 | A | | 1/1979 | Davis | |

(Continued)

*Primary Examiner* — William Pierce

(74) *Attorney, Agent, or Firm* — Mark D. Trenner; Trenner Law Firm, LLC

(57) ABSTRACT

An example of a practice device includes a top portion, a bottom portion, a middle portion extending along a longitudinal axis between the top and bottom portions, a neck portion extending between the top and middle portions, and a plurality of weights. The top portion includes a first cross section and at least two through-holes extending between front and rear surfaces. The bottom portion and middle portions include second and third cross sections, respectively. The neck includes a fourth cross section smaller than the third cross section. The weights have center holes smaller than the third cross section but larger than the first and fourth cross sections are configured for placement around the neck portion. Example methods of practicing and warming up may use various practice devices.

11 Claims, 8 Drawing Sheets

(56) References Cited

U.S. PATENT DOCUMENTS

| | | | | |
|---|---|---|---|---|
| 4,220,333 | A | 9/1980 | Mercer | |
| 4,333,647 | A | 6/1982 | Schaefer | |
| 4,367,872 | A | 1/1983 | Langston | |
| 4,377,282 | A * | 3/1983 | Hayes | 482/44 |
| 4,504,054 | A | 3/1985 | Jackson et al. | |
| 4,605,227 | A | 8/1986 | Hurd et al. | |
| 4,682,776 | A | 7/1987 | Mitchell et al. | |
| 4,696,468 | A * | 9/1987 | Dube | 482/109 |
| 4,729,565 | A | 3/1988 | Lanning | |
| 4,770,412 | A | 9/1988 | Wolfe | |
| D299,915 | S * | 2/1989 | Ullman et al. | D12/168 |
| 4,832,339 | A | 5/1989 | Danielak et al. | |
| 4,911,728 | A | 3/1990 | Rigel | |
| 4,925,187 | A | 5/1990 | Fleenor et al. | |
| 4,938,487 | A | 7/1990 | Ponsart | |
| 5,163,678 | A | 11/1992 | Rogers | |
| 5,222,733 | A | 6/1993 | Brunty | |
| D337,180 | S | 7/1993 | Bailey | |
| 5,441,255 | A | 8/1995 | Verbick | |
| 5,472,206 | A | 12/1995 | Manley et al. | |
| 5,611,735 | A | 3/1997 | Jackson | |
| 5,769,743 | A | 6/1998 | Stephan et al. | |
| 5,839,124 | A | 11/1998 | Tilton | |
| 5,906,546 | A | 5/1999 | Albert | |
| D419,630 | S | 1/2000 | Albarelli, Jr. | |
| D430,083 | S * | 8/2000 | Spearin | D12/168 |
| 6,283,872 | B1 | 9/2001 | Lichodziejewski et al. | |
| 6,656,056 | B1 | 12/2003 | Leonard | |
| 6,827,653 | B2 | 12/2004 | Be | |
| 7,261,638 | B2 | 8/2007 | Davis et al. | |
| 7,264,553 | B1 | 9/2007 | Addington et al. | |
| 7,399,240 | B2 | 7/2008 | Paukert et al. | |
| D578,169 | S | 10/2008 | Hamilton | |
| 7,431,657 | B2 | 10/2008 | Whitehead, II et al. | |
| 7,437,776 | B1 | 10/2008 | Brown | |
| 7,582,030 | B2 | 9/2009 | LaPergola | |
| 7,658,681 | B1 | 2/2010 | Malecha | |
| 7,789,763 | B1 | 9/2010 | Smith | |
| D684,640 | S | 6/2013 | Chen | |
| D691,669 | S | 10/2013 | Chen | |
| 2004/0176225 | A1 * | 9/2004 | Chen | 482/109 |
| 2005/0061905 | A1 * | 3/2005 | Sherman et al. | 242/388.2 |
| 2005/0193468 | A1 | 9/2005 | Chung | |
| 2007/0135274 | A1 * | 6/2007 | Blateri | 482/109 |
| 2008/0161120 | A1 | 7/2008 | Miller et al. | |
| 2009/0000002 | A1 | 1/2009 | Hadash | |
| 2009/0253527 | A1 | 10/2009 | Abraham | |
| 2012/0065027 | A1 * | 3/2012 | Zachary | 482/48 |
| 2013/0123072 | A1 * | 5/2013 | Marji | 482/44 |

* cited by examiner

BOWLING PRACTICE DEVICE AND METHOD

PRIORITY CLAIM

This application claims the benefit of U.S. Provisional Application No. 61/637,658 titled "Warm up and training device for bowling" of Rex William Byron, filed Apr. 24, 2012, and incorporated by reference as though fully set forth herein.

BACKGROUND

The sport of bowling has been played for thousands of years. Bowling today generally involves rolling a bowling ball down a bowling lane towards ten bowling pins arranged at the end of the lane. With better technique and warm-up, a bowler may be able to knock down more or even all of the pins.

Many bowlers struggle to swing their ball forward to the point of release with consistent positioning of the arm and hand. As with many sports, bowling requires specific conditioning to improve consistency. Historically, the only way to improve consistency of bowling form has been actually bowling. But bowling at a bowling alley on a daily basis can be logistically difficult, as well as expensive. Many bowlers have to participate in multiple bowling leagues to get the practice they need to improve their consistency.

DETAILED DESCRIPTION

Practice and warm-up routines can help a bowler bowl a better game. In addition, warming up muscles prior to participating in the sport of bowling can reduce or altogether prevent pulled and/or sore muscles and aching joints. However, practice and warm-up using an actual bowling ball may be impractical. For example, an actual bowling ball may not always be available to the bowler (e.g., a bowling ball is heavy to carry around), and using an actual bowling ball may be an excessively high level of intensity for a typical warm-up routine.

Practice devices and methods described herein may provide the user with a low-impact warm-up, helping stretch muscles used during a bowling game, as well as correct the user's bowling swing and approach. The devices and methods disclosed herein may be used by persons of any age or bowling ability, prior to bowling or between turns during a bowling game, for warm-up and/or practice. Accordingly, the devices and methods may help reduce risk of injury, create muscle memory, or a combination of these. Use of the practice devices and methods may be in a variety of locations such as, but not limited to a user's home, a backyard, an office, or at the bowling alley.

The practice device and method allows the user to mimic the motion of correctly swinging a bowling ball, such that various muscles used to swing a bowling ball are used, without having to use an actual bowling ball. For example, a user may use the practice device and method to expedite low impact warm-up of arm, shoulder, back, core, and leg muscles.

Before continuing, it is noted that as used herein, the terms "includes" and "including" mean, but are not limited to, "includes" or "including" and "includes at least" or "including at least." The term "based on" means "based on" and "based at least in part on."

Figure 1:
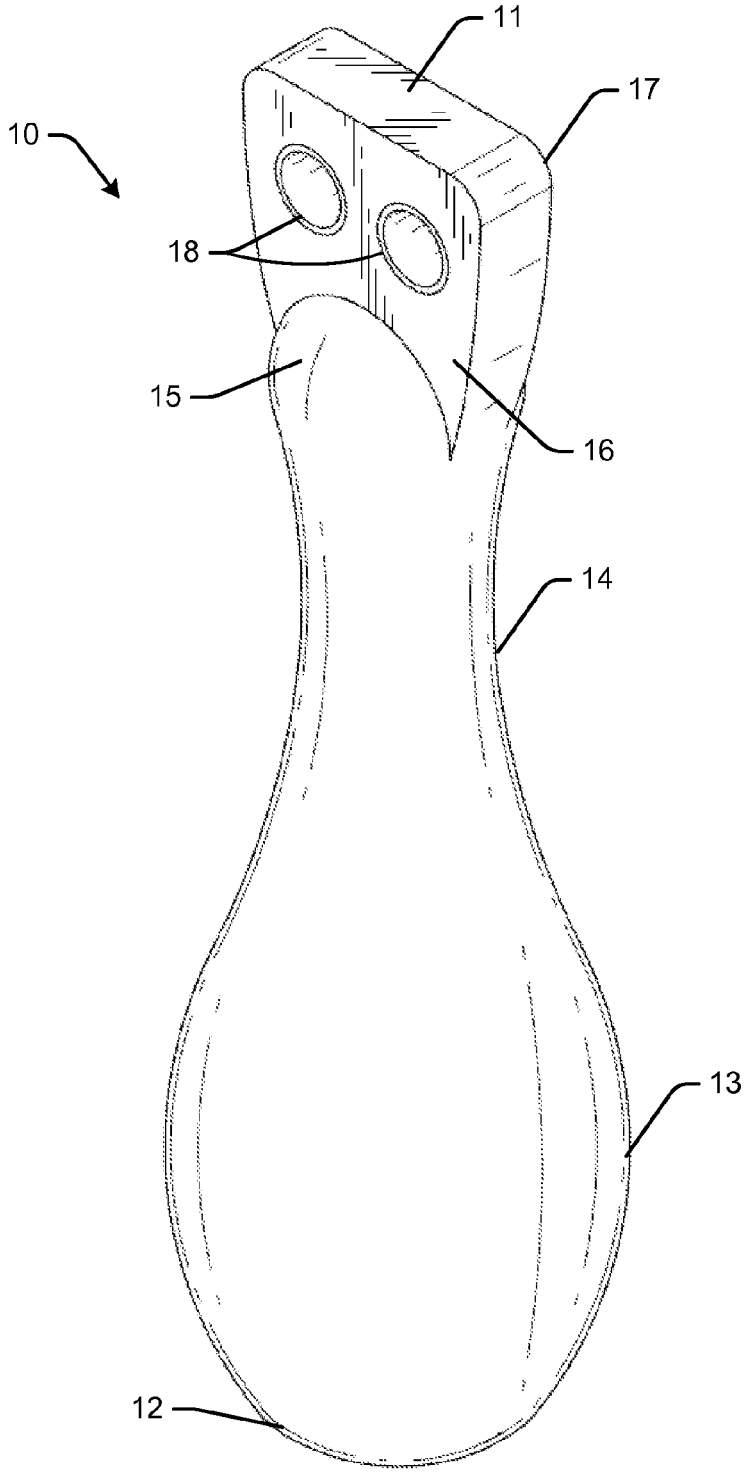
FIG. 1 illustrates a perspective view of an example bowling practice device.
Figure 2:
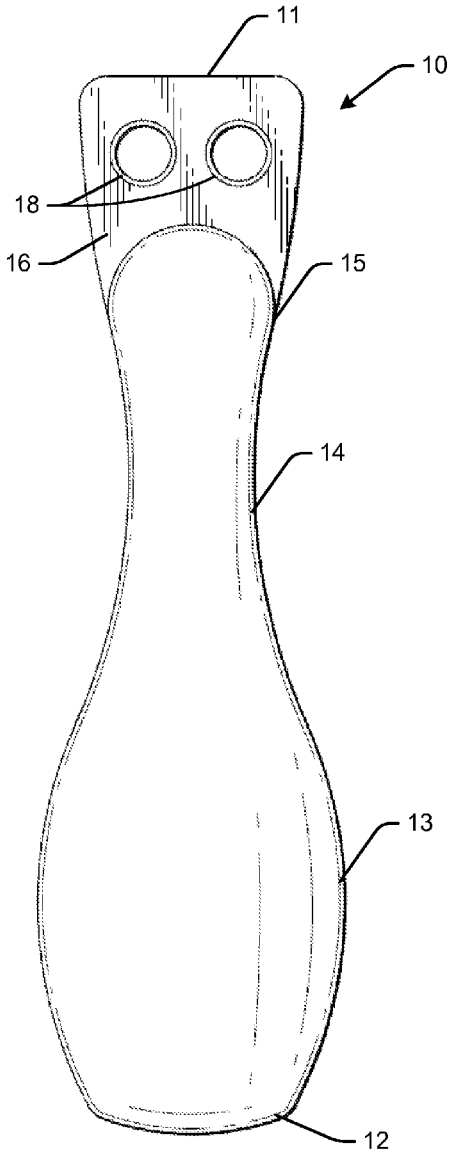
FIG. 2 illustrates a front view of an example bowling practice device.
Figure 3:
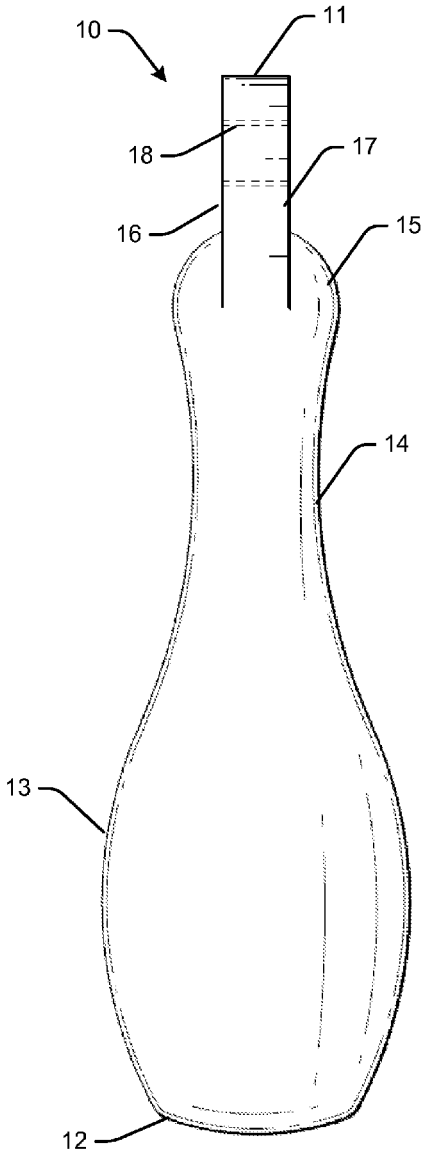
FIG. 3 illustrates a side view of an example bowling practice device.
Figure 4:
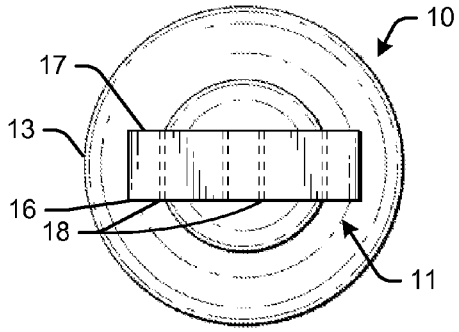
FIG. 4 illustrates a top view of an example bowling practice device.
Figure 5:
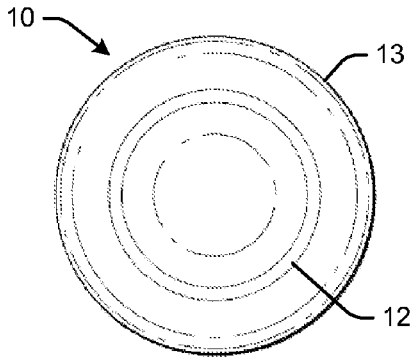
FIG. 5 illustrates a bottom view of an example bowling practice device.

FIG. 1 illustrates a perspective view of an example bowling practice device. FIG. 2 illustrates a front view of an example bowling practice device. FIG. 3 illustrates a side view of an example bowling practice device. FIG. 4 illustrates a top view of an example bowling practice device. FIG. 5 illustrates a bottom view of an example bowling practice device.

In the example illustrated in FIGS. 1-5, the practice device 10 includes a top portion 11 having a first cross section and a bottom portion 12 having a second cross section. A middle portion 13 extends along a longitudinal axis between the top 11 and bottom 12 portions, and has a third cross section. Neck portion 14 extends between the top 11 and middle 13 portions, and has a fourth cross section. A transition zone 15 may be provided between neck portion 14 and top portion 11.

With particular reference to FIG. 1-3, the cross section at the middle portion 13 (the third cross section) may be larger than the other cross-sections. Additionally, the first, second and third cross sections may be larger than the fourth cross section. The middle portion 13 may have a circular cross section between a distal end of the neck portion 14 and the bottom portion 12.

Top portion 11 is shown including front surface 16 and rear surface 17 lying in planes generally parallel with the longitudinal axis. At least two through-holes 18 are shown as these may extend between the front surface 16 and rear surface 17. Through-holes 18 may be of a size and shape (and are generally configured to) accommodate insertion of user fingers into and through practice device 10. It is noted that in other examples there may be more than two through-holes 18.

In an example, the holes 18 may extend between front 16 and rear 17 surfaces such that their central axes are generally perpendicular to the longitudinal axis and generally parallel with normal lines of surfaces 16 and 17. In some examples, these central axes lie within the same horizontal plane while in other examples, the central axes may lie in oblique planes.

Device 10 may be formed from a variety of generally resilient materials such as, for example, molded rubber or plastic. In some examples, part or all of the device may include materials such as rope or metal and a core wire may be included to add rigidity to the device.

In some examples, the practice device 10 includes an internal weight in middle portion 13, near bottom portion 12. The weight may be a separate material integrated within the body of practice device 10 or the material or materials from which practice device 10 is formed may have a greater density within middle portion 13. Alternatively, providing a greater volume of material in middle portion 13 may also cause a greater amount of mass to be present in middle portion 13.

Off-center weighting, material flexibility and a neck 14 with cross section smaller than that of middle portion 13 may contribute to minor flexion of bottom portion 12 relative to top portion 11 when device 10 is held in a horizontal orientation by top portion 11. During use, this property may encourage a user to maintain their arm with elbow joint extended to create a controlled fluid swinging motion.

It is noted that the practice device 10 may be available in various colors and various sizes to accommodate the needs and desires of various users. For example, practice device 10 may be between about 0.15 meters and about 0.30 meters in length from the top 11 to the bottom 12, and may have a mass of between about 0.9 kg and about 7.25 kg.

Figure 6:
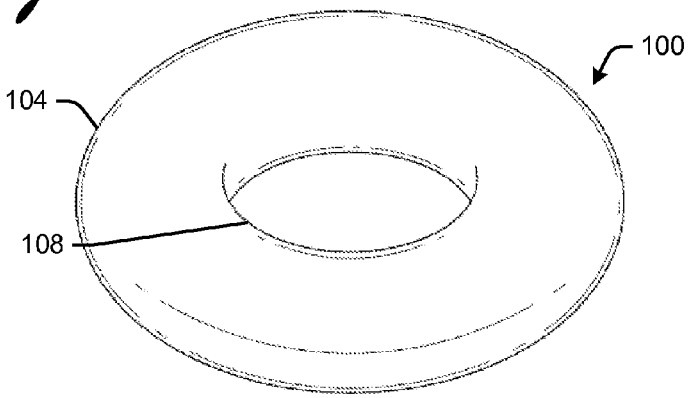
FIGS. 6-7 illustrates a perspective view of an example accessory weight.
Figure 7:
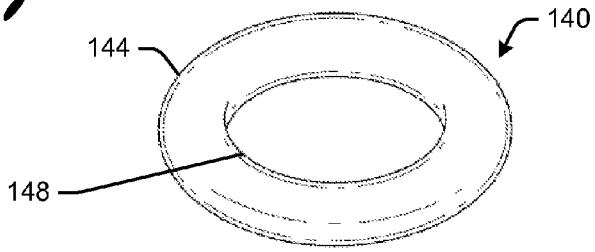

One or more weights which may be added to a practice device to provide added resistance when a user has become skilled with lesser weights or if a user is just naturally strong enough to require more weight than provided by a practice device alone. FIG. 6 and FIG. 7 illustrate a perspective view of an example accessory weight 100.

In an example, the weight 100 has a toroidal shape and may even be a true torus. The center hole 108 of the weight 100 may be configured to fit over a top portion and a neck portion of a practice device; but be prevented from passing over a middle portion. For example, the central hole 108 may have a diameter greater than top portion 11 and neck portion 14, but smaller than the effective diameter of middle portion 13. The diameter of the center hole 108 may be larger or smaller than the effective diameter of the end portion 12, for example, as long as the middle portion 13 has a diameter larger than that of the center hole 108.

In another example, a plurality of weights of varying size and/or mass, for example, weight 100 and weight 140, may be provided to the user to configure the device using a variety of resistances. This also enables different users to customize the same practice device using the weight set.

When not in use around a neck portion of a practice device, some of weights 100, 140 may be useable as a rest for supporting a bowling ball on, for example, a generally planar horizontal surface.

Figure 8:
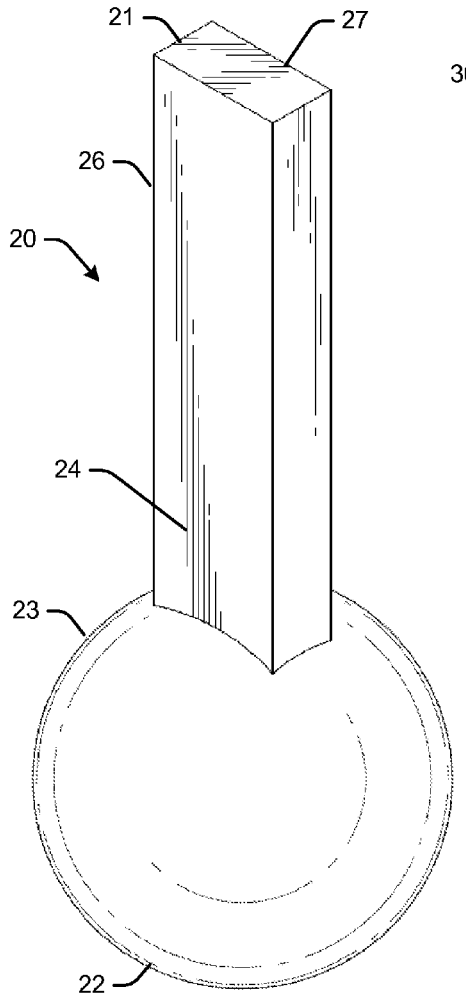
FIGS. 8-10 illustrates a perspective view of another example bowling practice device.
Figure 9:
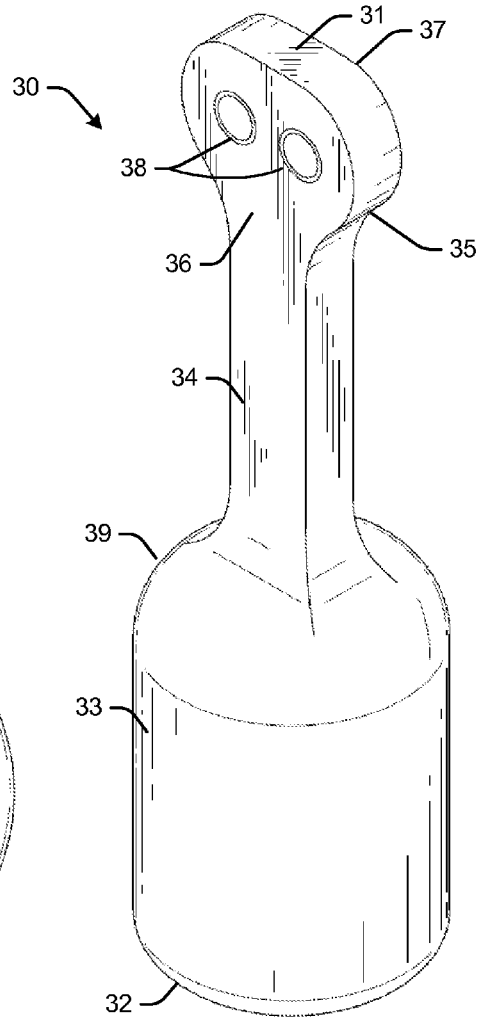
Figure 10:
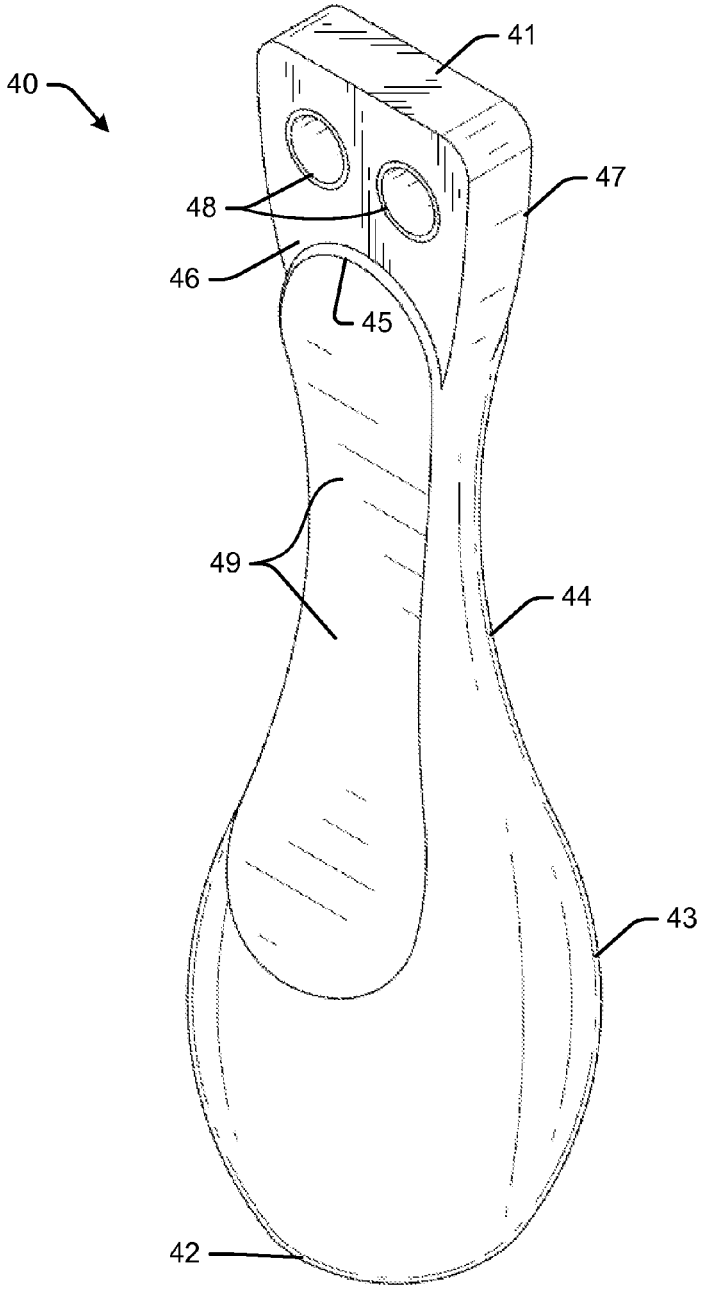

FIGS. 8-10 are perspective views of other example bowling practice devices. The practice device 20 shown in FIG. 8 includes a neck portion 24 extending approximately halfway between the top 21 and bottom portions 22. The neck portion 24 has a generally rectangular cross section and planar surfaces 26 and 27. The bottom 22 and middle 23 portions together form a spherical shape.

Device 20 may be formed from a variety of generally resilient materials, such as but no limited to, molded rubber or plastic. In some examples, part (including all) of the device may include materials such as rope or metal. A core wire may be included to add rigidity to the device.

In an example, the practice device 20 includes an internal weight in middle portion 23, near bottom portion 22. The weight may be a separate material integrated within the body of practice device 20 or the material or materials from which practice device 20 is formed may have a greater density within middle portion 23. Alternatively, simply by having greater volume of material in middle portion 23 a greater amount of mass may be present in middle portion 23.

As with the disclosed first example, off-center weighting, material flexibility and a neck 24 with cross section smaller than that of middle 23 and bottom 22 portions may contribute to minor flexion of bottom portion 22 relative to top portion 21 when device 20 is held in a horizontal orientation by top portion 21. During use, this property may encourage a user to maintain their arm with elbow joint extended to create a controlled fluid swinging motion.

Weights such as those described with reference to FIGS. 6 and 7 may also be used. For example, center hole 108 of weight 100 may be configured to fit over top portion 21 and neck portion 24, but to be prevented from passing over middle portion 23. Upon being placed over top portion 21, weight 100 may come to rest, for example on an upper portion of the spherical shape formed by middle 23 and bottom 22 portions.

The practice device 30 shown in FIG. 9 includes a neck portion 34 which extends approximately halfway between top 31 and bottom portions 32 and has a generally rectangular cross section. A first, curved transition zone 35 may be formed at the junction of neck portion 34 and top portion 31.

A middle portion 33 has a circular cross section between a distal end of the neck portion 34 and the bottom portion 32. The circular cross section of the middle portion 33 may be of a generally consistent size between the distal end of the neck portion and the bottom portion 32. A second transition zone 39, between the distal end of the neck portion 34 and the proximal end of the circular cross section 33, may include a hemispherical shape.

Top portion 31 and neck portion 34 include front 36 and rear 37 surfaces lying in planes generally parallel with the longitudinal axis. At least two through-holes 38 extend between the front 36 and rear 37 surfaces. Through-holes 38 are of a size and shape for, and are generally configured to, accommodate insertion of user fingers into and through practice device 30. In some examples, there may be more than two through-holes 38.

Through holes 38 may extend between front 36 and rear 37 surfaces such that their central axes are generally perpendicular to the longitudinal axis and generally parallel with normal lines of surfaces 36 and 37. In some examples, these central axes lie within the same horizontal plane while in other examples, the central axes may lie in oblique planes.

The device 30 may be formed from a variety of generally resilient materials such as, for example, molded rubber or plastic. In some examples, part or all of the device may include materials such as rope or metal and a core wire may be included to add rigidity to the device.

In an example, practice device 30 includes an internal weight in middle portion 33, near bottom portion 32. The weight may be a separate material integrated within the body of practice device 30 or the material or materials from which practice device 30 is formed may have a greater density within middle portion 33. In another example, simply by having greater volume of material in middle portion 33 a greater amount of mass may be present in middle portion 33.

Off-center weighting, material flexibility and a neck 34 with cross section smaller than that of middle 33 and bottom 32 portions may contribute to minor flexion of bottom portion 32 relative to top portion 31 when device 30 is held in a horizontal orientation by top portion 31. During use, this property may cause a user to maintain their arm with elbow joint extended to create a controlled fluid swinging motion.

Weights such as those described with reference to FIGS. 6 and 7 may also be used. For example, center hole 108 of weight 100 may be configured to fit over top portion 31 and neck portion 34 but to be prevented from passing over middle portion 33 so as to generally rest upon transition zone 39.

Practice device 40 is shown in FIG. 10 with a middle portion 43 and neck portion 44 that includes a scalloped surface 49 on at least a front side. Other examples may include one or more additional scalloped surfaces at a rear side, a right side, a left side or a combination of these. A transition zone 45 may be formed between scalloped surfaces and top portion 41. As with the example of the first example, top portion 41 of the fourth example may also include at least two planar surfaces 46 and 47 extending from the top portion 41 towards the bottom portion 42 generally parallel with the longitudinal axis.

At least two through-holes 48 extend between the front 46 and rear 47 surfaces and include central axes which, in some examples, may be approximately parallel with the normal lines of surfaces 46 and 47. In some examples, these central axes lie within the same horizontal plane while in other examples, the central axes may lie in oblique planes.

The device 40 may be formed from a variety of generally resilient materials such as, for example, molded rubber or plastic. In some examples, part or all of the device may include materials such as rope or metal and a core wire may be included to add rigidity to the device.

The example practice device 40 may include an internal weight in middle portion 43, near bottom portion 42. The weight may be a separate material integrated within the body of practice device 40 or the material or materials from which practice device 40 is formed may have a greater density within middle portion 43. Alternatively, simply by having greater volume of material in middle portion 43 a greater amount of mass may be present in middle portion 43.

As discussed above, off-center weighting, material flexibility and a neck 44 with cross section smaller than that of middle 43 and bottom 42 portions may contribute to minor flexion of bottom portion 42 relative to top portion 41 when device 40 is held in a horizontal orientation by top portion 41. During use, this property may cause a user to maintain their arm with elbow joint extended to create a controlled fluid swinging motion.

Weights such as those described with reference FIGS. 6 and 7 may be used with this example. For example, center hole 108 of weight 100 may be configured fit over the top portion 41 and neck portion 44 but to be prevented from passing over the middle portion 43. In some examples, a weight placed over top portion 41 may come to rest at a lower portion of scalloped surface 49.

Before continuing, it should be noted that the examples described above are provided for purposes of illustration, and are not intended to be limiting. Other devices and/or device configurations may be utilized to carry out the operations described herein.

It is also noted that additional components may be included with the exercise device and/or weights kits. An example component includes a pointer (e.g., a laser pointer) configured to be coupled to one or more practice devices allowing a bowler to hit a particular mark when releasing the ball. A user may choose to mark, for example, a dot or arrow indicated on a bowling lane or the bowling pins themselves. This may assist training a user to look for their mark, hit their mark, and create a consistent fluid swing allowing him or her to hit his or her mark with each swing.

Another example component includes a cushion of flexible foam having any of a variety of shapes, for example, animals or letters and configured to be coupled to a practice device. The cushion may offer padding against any impact of a practice device with the user's shoulder during full-swing practice.

Figure 11:
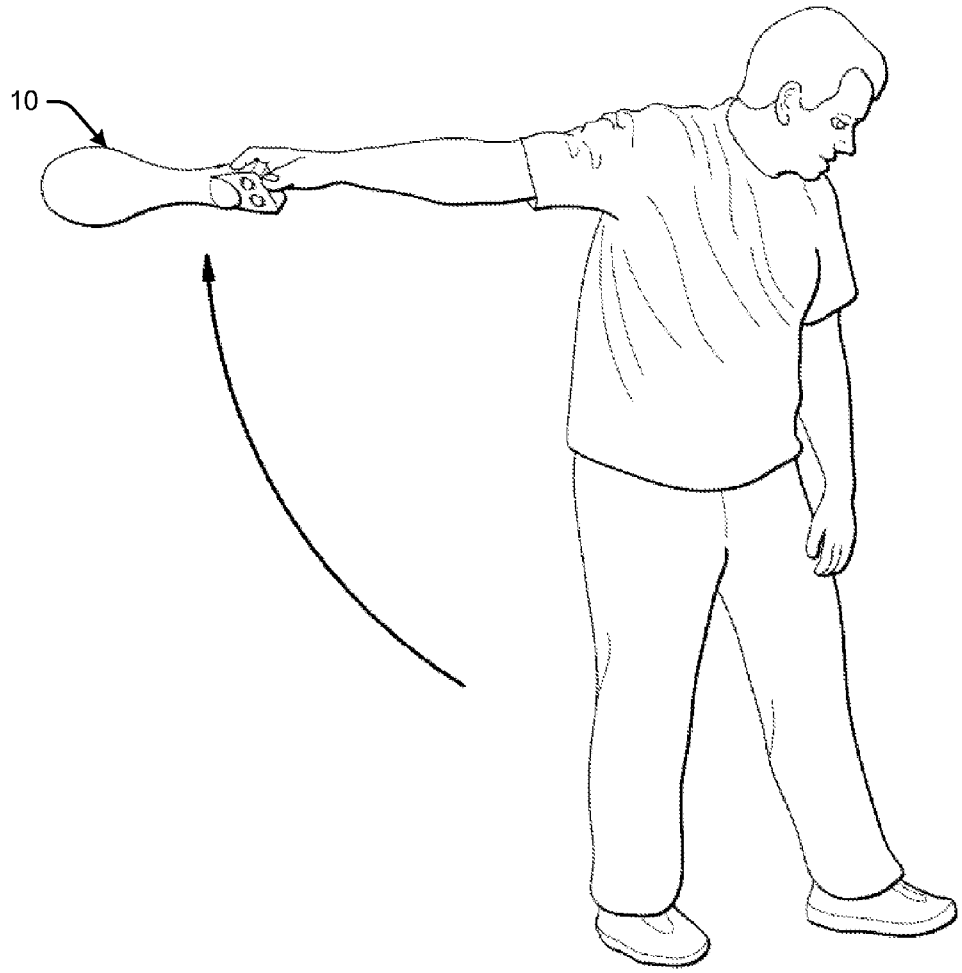
FIG. 11 illustrates an example use of a bowling practice device, wherein the user is depicted in a backswing position.
Figure 12:
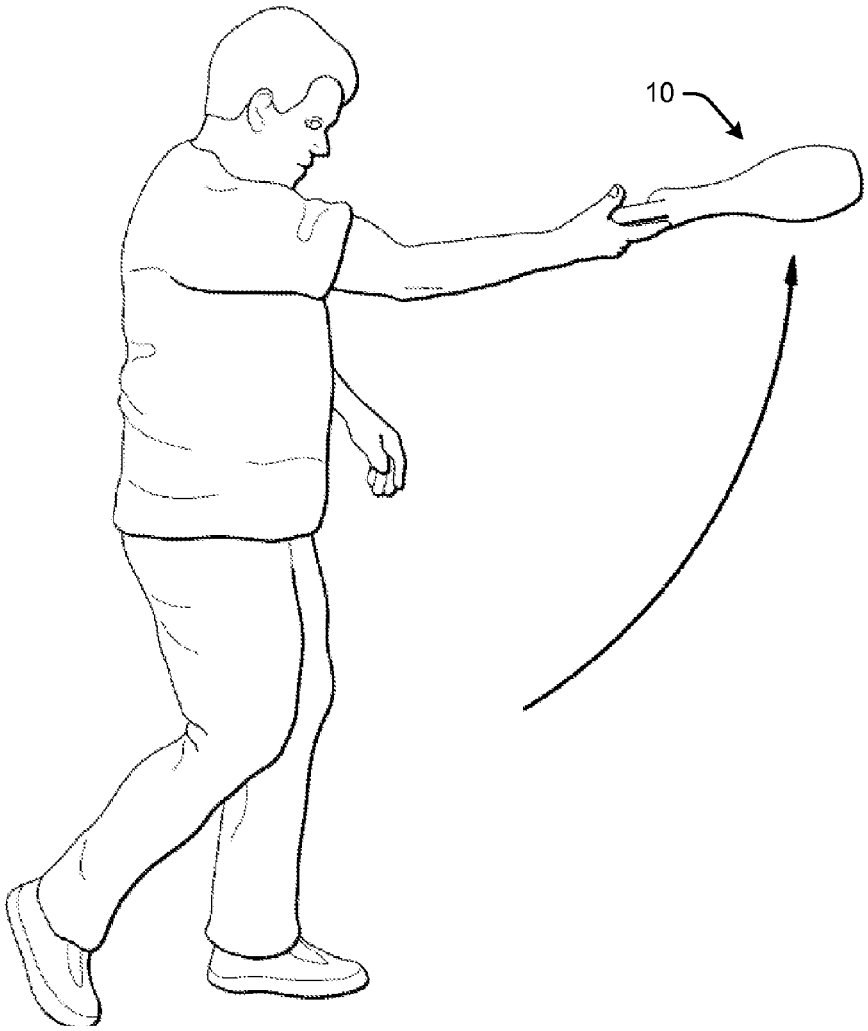
FIG. 12 illustrates an example use of a bowling practice device, wherein the user is depicted in a forward swing position.
Figure 13:
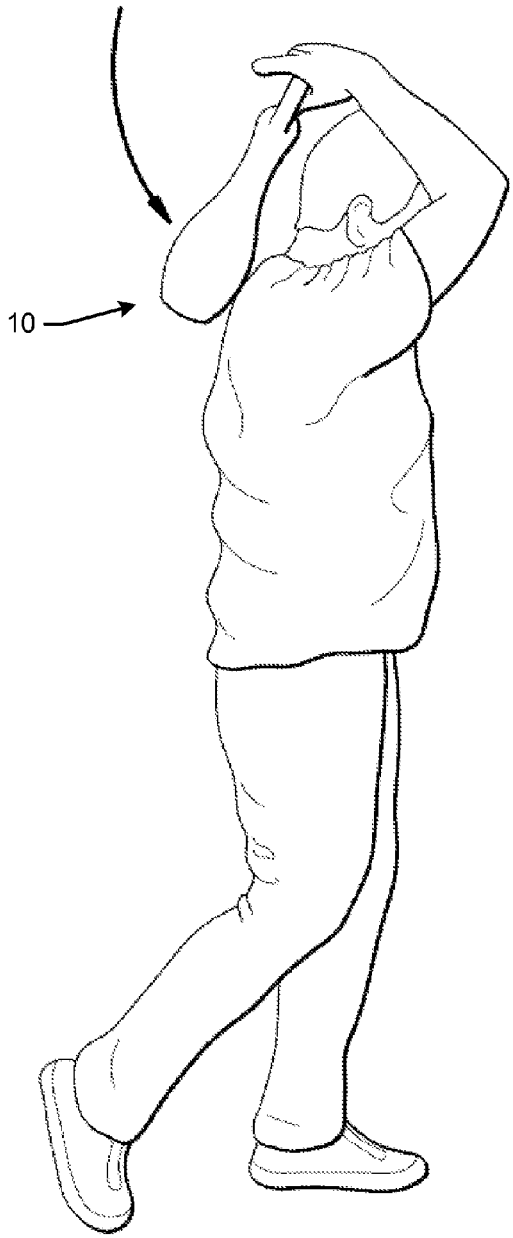
FIG. 13 illustrates an example use of a bowling practice device, wherein the user is depicted in a follow-through position.

FIGS. 11-13 depict stages of using a warm up device. FIG. 11 illustrates an example use of a bowling practice device, wherein the user is depicted in a backswing position. FIG. 12 illustrates an example use of a bowling practice device, wherein the user is depicted in a forward swing position. FIG. 13 illustrates an example use of a bowling practice device, wherein the user is depicted in a follow-through position.

Although illustrated with reference to practice device 10, it is noted that any of the example practice devices may be used in the method illustrated in FIGS. 11-13. A controlled and repeated motion of a practice device in accordance with methods of the present disclosure may be beneficial to warm-up and developing a proper swing for delivery of the bowling ball.

In an example, a user may grasp the generally elongate practice device 10 by a top portion, placing one finger into each of at least two through-holes. The user may place one finger into one of the through-holes (e.g., a ring finger) and another finger into one of the through-holes (e.g., a middle finger).

While grasping the practice device by a top portion with his or her arm in supination, the user alternately flexes and extends his or her shoulder joint from a neutral position, to swing the practice device towards a forward position (e.g., as depicted in FIG. 12) and towards a rearward position (e.g., as depicted in FIG. 11).

In an example, the user's arm is maintained in a generally supinated, generally extended configuration in a single vertical plane during swinging. However, in other examples, the relative positions of joints and bones of a user may vary from generally supinated and generally extended configurations. For example, the upper and lower portions of an arm of a user form an angle of less than approximately 180 degrees.

Performing repeated, controlled and fluid swinging motion of a practice device may help the user to achieve benefits, such as warming up muscles and training a proper swing for proper use of a bowling ball.

It is noted that the user may alternately swing a practice device towards forward and rearward positions which are approximately horizontal as in depicted, for example, in FIGS. 11-12. In such examples, the user completes an arc of approximately 180 degrees with each swing between forward and backward positions.

The above-described motions may comprise a simple, first level of practice using a practice device. As a user becomes more comfortable with using a practice device in accordance with first level motions, additional motions may be added to the method to yield a second level of practice.

For example, at a second level, a user may take a step forward while swinging a device towards the forward position, and take a step backward while swinging a device towards the backward position or both. With these added motions, a user may facilitate warm-up of a more comprehensive set of muscles used during bowling. A user may experience additional difficulty in maintaining fluid motion of a swinging practice device by adding the second level motions.

As a user becomes comfortable with stepping forward, backward or both while swinging a practice device, he or she may desire added difficulty or incorporation of a still more comprehensive set of muscles. A follow-through motion may be added, as depicted by way of example in FIG. 13. While swinging a practice device towards the forward position, instead of stopping the swing at 180 degrees, a user may continue the swing up and over his or her shoulder. When the user's shoulder joint approaches full extension with the practice device generally above, the user may flex his or her elbow joint until the practice device is held generally behind the shoulder joint.

With a practice device behind the shoulder joint, the user may reverse the swing to bring the practice device around in front of his or her body as they take a step backward. This motion may mimic a desirable, full follow-through when delivering a bowling ball.

In this example, the arm of the user is maintained in a generally supinated configuration during swinging. However, in some examples, the relative positions of joints and bones of a user may vary from generally supinated.

In another example of practice method (not shown), a user may perform a motion to mimic a bowling finish pose, the last position that the body is in at the moment a bowling ball is released onto the bowling lane. While in a finish pose, a user may swing a practice device forward and backward while balancing on one foot in a slightly crouched position. The user may stay in a finish pose during an entire full follow-through swing. This example may require the user to maintain balance and form.

In this example, the arm of the user is maintained in a generally supinated configuration during swinging. However, in other examples, the relative positions of joints and bones of a user may vary from generally supinated.

In yet another example of a practice method (not shown), a user may take multiple steps forward while executing a full swing between neutral, backward and forward positions. The method ends in a finish pose as described above. Such a method may mimic bowling approach. In other examples, the number of steps taken may correspond with the number of steps a user would take during the same motion executed during bowling. This may be any number of steps including but not limited to 4, 5 or 15.

After holding a practice device in a finish pose, the user may step back to his or her starting position and begin again. Performing a fluid swinging motion of a practice device while taking the several steps forward and ending in a finish pose with a full follow-through may mimic motions taken when bowling and allow the user to improve the timing of his or her swing.

The operations shown and described herein are provided to illustrate example implementations. It is noted that the operations are not limited to the ordering shown. Still other operations may also be implemented.

Still further examples of a method of practice (not shown) may include an additional level of practice. According to another example of practice method, a user may provide additional power when the swing comes toward the forward position. After the additional power and as the swing moves past an approximately horizontal position, the user may slow the swing to achieve controlled motion on a full follow-through depicted, for example, in FIG. 13. When the user reverses the swing, he or she may bring a practice device around in front of his or her body as he or she takes a step backward and finishes a swing toward the rearward position. Practicing a method in accordance with this example may facilitate learning to add power to the delivery of a ball when bowling.

During performance of any above-disclosed examples of practice methods, the practice device is not released from the hand during the swinging motion. In other examples, release of the practice device from the hand during the swinging motion may be desirable.

It is noted that the examples shown and described are provided for purposes of illustration and are not intended to be limiting. Still other examples are also contemplated.

What is claimed is:

1. A bowling practice device, comprising:

a top portion including a first cross section and at least two through-holes extending between front and rear surfaces;

a bottom portion including a second cross section;

a middle portion extending along a longitudinal axis between the top and bottom portions and including a third cross section;

a neck portion extending between the top portion and the middle portion, the neck portion including a fourth cross section smaller than the third cross section;

at least one weight placed around the neck portion and including a center hole smaller than the third cross section; and a plurality of additional weights.

2. A bowling practice device, comprising:

a top portion including a first cross section, at least one front surface and at least one rear surface;

a bottom portion including a second cross section;

a middle portion extending along a longitudinal axis between the top and bottom portions and including a third cross section; and a neck portion extending between the top portion and the middle portion and including a fourth cross section.

3. The bowling practice device of claim 2, wherein the third cross section is larger than each of the first cross section, the second cross section and the fourth cross section.

4. The bowling practice device of claim 2, further comprising:

at least two through-holes extending between the front and rear surfaces and configured to accommodate insertion of user fingers.

5. The bowling practice device of claim 2, wherein the middle portion, near the bottom portion, further comprises an internal weight.

6. The practice device of claim 5, wherein, when the device is held in a horizontal orientation, with the top portion fixed, the bottom portion experiences minor flexion relative to the top portion.

7. The practice device of claim 2, further comprising:

a plurality of weights of varying size and mass each having a toroidal shape including a center hole configured to fit over the top portion and neck portion but to be prevented from passing over the middle portion.

8. The practice device of claim 2, wherein the fourth cross section is rectangular.

9. The practice device of claim 8, wherein, the middle portion further comprises a circular cross section between a distal end of the neck portion and the bottom portion.

10. The practice device of claim 2, wherein the bottom portion includes a spherical shape.

11. The practice device of claim 2, wherein the middle portion includes a scalloped surface on at least a front side.

* * * * *